US010545442B1

(12) United States Patent
Hirano et al.

(10) Patent No.: US 10,545,442 B1
(45) Date of Patent: Jan. 28, 2020

(54) IMAGE HEATING APPARATUS

(71) Applicant: CANON KABUSHIKI KAISHA, Tokyo (JP)

(72) Inventors: Shigeru Hirano, Tokyo (JP); Ikuo Nakamoto, Matsudo (JP); Shigeru Tanaka, Tokyo (JP); Akihiro Maeda, Tokyo (JP); Yusuke Yamaguchi, Nagareyama (JP); Shohei Tsuzaki, Yoshikawa (JP); Kenji Endo, Tokyo (JP); Shinsuke Takahashi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/446,926

(22) Filed: Jun. 20, 2019

(30) Foreign Application Priority Data

Jul. 27, 2018 (JP) ..... 2018-140918

(51) Int. Cl.
*G03G 15/20* (2006.01)
*G03G 21/16* (2006.01)

(52) U.S. Cl.
CPC ..... *G03G 15/2064* (2013.01); *G03G 15/2017* (2013.01); *G03G 15/2028* (2013.01); *G03G 15/2053* (2013.01); *G03G 21/1685* (2013.01); *G03G 2215/2019* (2013.01)

(58) Field of Classification Search
CPC ..... G03G 15/2064; G03G 15/2028; G03G 15/2053; G03G 15/2017; G03G 2215/2019; G03G 21/1685
See application file for complete search history.

(56) References Cited

U.S. PATENT DOCUMENTS 9,217,971 B1 * 12/2015 Matsumoto ..... G03G 15/206
2013/0164056 A1 * 6/2013 Imada ..... G03G 15/2042 399/329
2015/0043953 A1 * 2/2015 Nakamoto ..... G03G 15/2025 399/329

FOREIGN PATENT DOCUMENTS

JP 2015-132728 A 7/2015
JP 2015-135528 A 7/2015

* cited by examiner

*Primary Examiner* — Joseph S Wong
(74) *Attorney, Agent, or Firm* — Venable LLP

(57) ABSTRACT

An image heating apparatus includes an endless belt, a rotary member configured to form a nip portion with the endless belt, regulating members for regulating the endless belt from moving in a longitudinal direction by being in contact with longitudinal ends of the endless belt, and a sheet-like heating member. The heating member includes a heat transfer member in contact with the inner surface of the endless belt, and a heating portion located on an opposite side from a side, of the heating member, in contact with the inner surface of the endless belt across the heat transfer member. Both end portions of the heat transfer member are disposed at the same location or outside of both end portions of the heating portion in the longitudinal direction and are disposed inside of both end portions of the rotary member in the longitudinal direction.

8 Claims, 11 Drawing Sheets

IMAGE HEATING APPARATUS

BACKGROUND OF THE INVENTION

Field of the Invention

The present disclosure relates to a fixing unit serving as an image heating apparatus implementing a heating process on a recording material, i.e., a recording medium or a recorded material, bearing a non-fixed image or a fixed image.

Description of the Related Art

The image heating apparatus is put into practical use as a fixing unit fixing a non-fixed image born on a recording material onto the recording material, a temporal fixing unit for temporally fixing a non-fixed image on a recording material or as a surface modifying apparatus modifying surface nature of a recording material bearing a fixed image.

For convenience, the following description will be made by exemplifying the fixing unit heating and fixing a toner image on a recording material such as a transfer material sheet, an electro-fax sheet, an electrostatic recording sheet, an OHP sheet, a copy sheet, a format sheet and an envelope provided in an image forming apparatus such as a copying machine and a printer.

There have been known various fixing units heating and fixing a non-fixed image, i.e., a toner image, of image information, which has been formed and borne on a recording material by a transfer method or a direct method by an appropriate image forming process such as electro-photographic process, electrostatic recording process and magnetic recording process, on the recording material as a fixed image.

Lately, an apparatus of a belt (film) heating system is put into practical use from aspects of quick start and energy saving. In this system, a recording material bearing a non-fixed image is inserted through a pressure contact nip portion defined by a heater serving as a heating member and a pressure roller serving as a pressure member through an endless belt (film) serving as a fixing member. Then, the system fixes the non-fixed image on the recording material conveyed to the pressure contact nip portion together with the belt by heat from the heater applied through the belt and pressure of the pressure contact nip portion.

Japanese Patent Application Laid-open Nos. 2015-132728 and 2015-135528 also disclose a fixing unit including a so-called sheet-like heating element. This fixing unit is provided with a sheet-like heating member heating an endless belt on an inner circumferential surface of the belt to heat the endless belt in a wide range by being in contact with the belt along a circumferential direction from the inner circumferential surface.

In a case where a heat transfer layer is provided between the heat transfer layer and the inner surface of the fixing member to efficiently transfer heat of the sheet-like heating element to the fixing member, while thermal conductivity in a thickness direction increases, thermal conductivity in a longitudinal direction also increases.

Due to that, in a case where a longitudinal length of the heat transfer layer is longer than a length of the pressure member, heat transfer to the pressure member drops in an area where the fixing member is not in contact with the pressure member. Then, fixing member temperature increases and Young's modulus drops, possibly accelerating abrasion between an end of the fixing member and a flange abutment surface.

SUMMARY OF THE INVENTION

The present disclosure provides an image heating apparatus whose durability is improved.

According to one aspect of the present disclosure, An image heating apparatus configured to heat an image on a recording material, includes an endless belt, a rotary member configured to form a nip portion, in which the recording material is nipped and conveyed and the image on the recording material is heated, with the endless belt, regulating members including regulating surfaces for regulating the endless belt from moving in a longitudinal direction by being in contact with longitudinal ends of the endless belt, and a sheet-like heating member provided inside of the endless belt. The heating member includes a fixed area located at a first end side in a rotation direction of the endless belt and fixed to an internal member of the endless belt and a heating area configured to be in contact with an inner surface of the endless belt along a peripheral direction in an area different from an area forming of the nip portion in the peripheral direction of the endless belt and to heat the endless belt. The heating member includes a heat transfer member in contact with the inner surface of the endless belt, and a heating portion located on an opposite side from a side, of the heating member, in contact with the inner surface of the endless belt across the heat transfer member. Both end portions of the heat transfer member are disposed at the same location or outside of both end portions of the heating portion in the longitudinal direction and are disposed inside of both end portions of the rotary member in the longitudinal direction.

Further features of the present invention will become apparent from the following description of exemplary embodiments with reference to the attached drawings.

DESCRIPTION OF THE EMBODIMENTS

First Embodiment

Printer Portion

Figure 2:
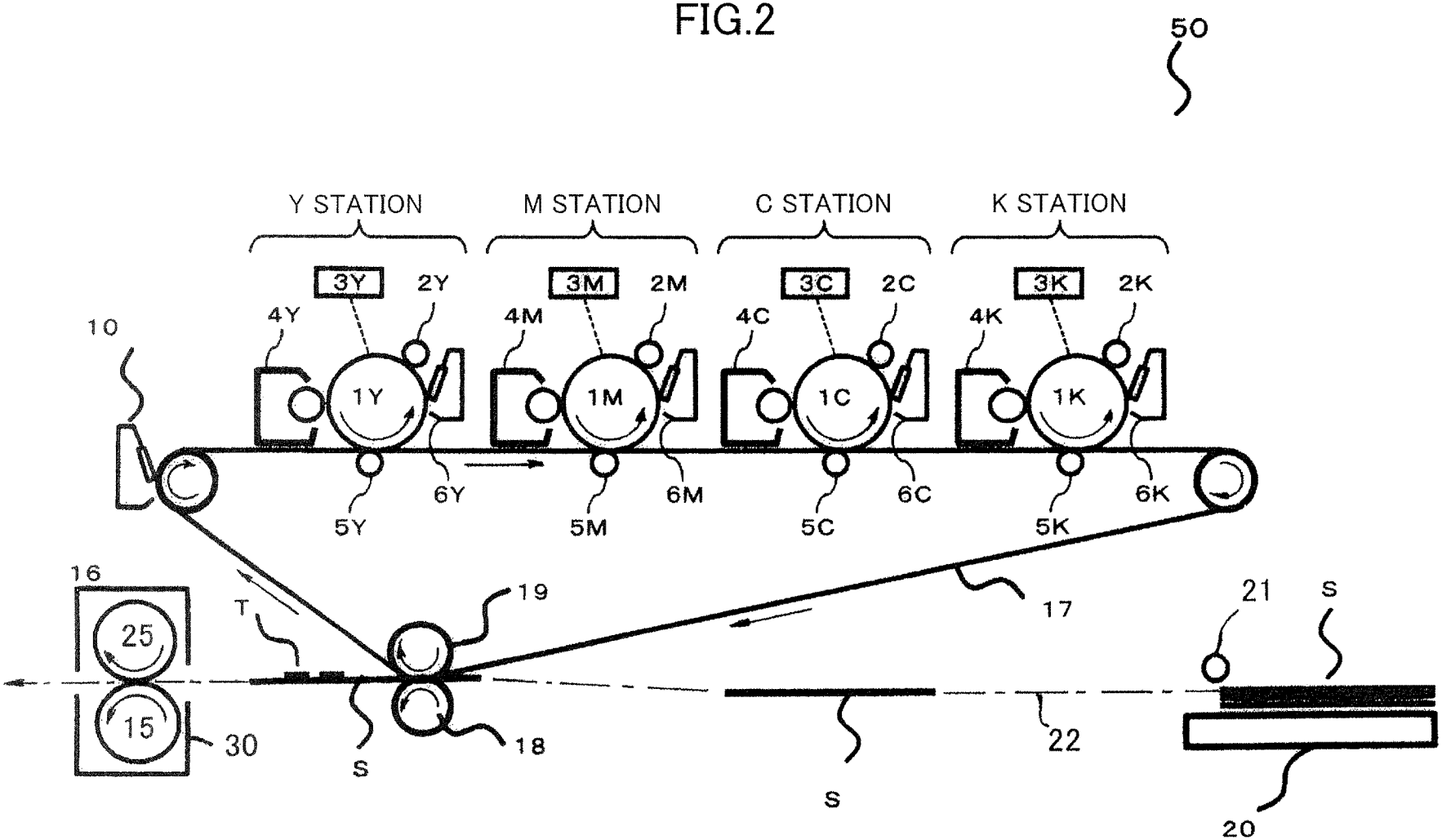
FIG. 2 is a schematic diagram of an image forming apparatus of the first embodiment.

One example of an image forming apparatus, i.e., a full-color printer using an electro-photographic technology of a present embodiment, carrying a fixing unit 16 to which the present disclosure is applied will be described with reference to FIG. 2. A printer unit 50 serving as an image forming portion of forming a toner image on a recording material S includes four image forming stations for forming four toner images of yellow (Y), magenta (M), cyan (C) and black (K).

Each of the stations of Y, M, C and K includes a drum-shape electro-photographic sensitive member 1 (Y, M, C and K), a charging roller 2 (Y, M, C and K), an exposing unit 3 (Y, M, C and K), a developer 4 (Y, M, C and K), a primary transfer roller 5 (Y, M, C and K) and a drum cleaner 6 (Y, M, C and K). The printer portion 50 also includes an endless belt 17 serving as an intermediate transfer belt bearing and conveying toner images transferred by the primary transfer roller 5 from the electrophotographic sensitive member 1 of each of the stations and a secondary transfer roller 18 transferring the toner image from the belt 17 to the recording material S. The printer portion 50 also includes a belt cleaner 10 and a secondary transfer counter roller 19.

An image forming operation of the printer portion 50 described above is known, so that a detailed description thereof will be omitted here. The sheet S stored in a recording material cassette 20 is separated one by one by a feed roller 21 and is nipped and conveyed by a secondary transfer nip portion defined by the belt 17 and the secondary transfer roller 18 along the conveyance path 22. The recording material S onto which a toner image T has been transferred from the belt 17 at the secondary transfer nip portion is sent to a fixing unit 16 serving as an image heating apparatus and composing a fixing portion. The toner image T is heated and pressurized in the fixing unit 16 to be fixed as a fixed image on the recording material S. Then, the recording material S on which the toner image has been fixed is outputted, i.e., printed out, as a printing product.

Fixing Unit

Figure 1:
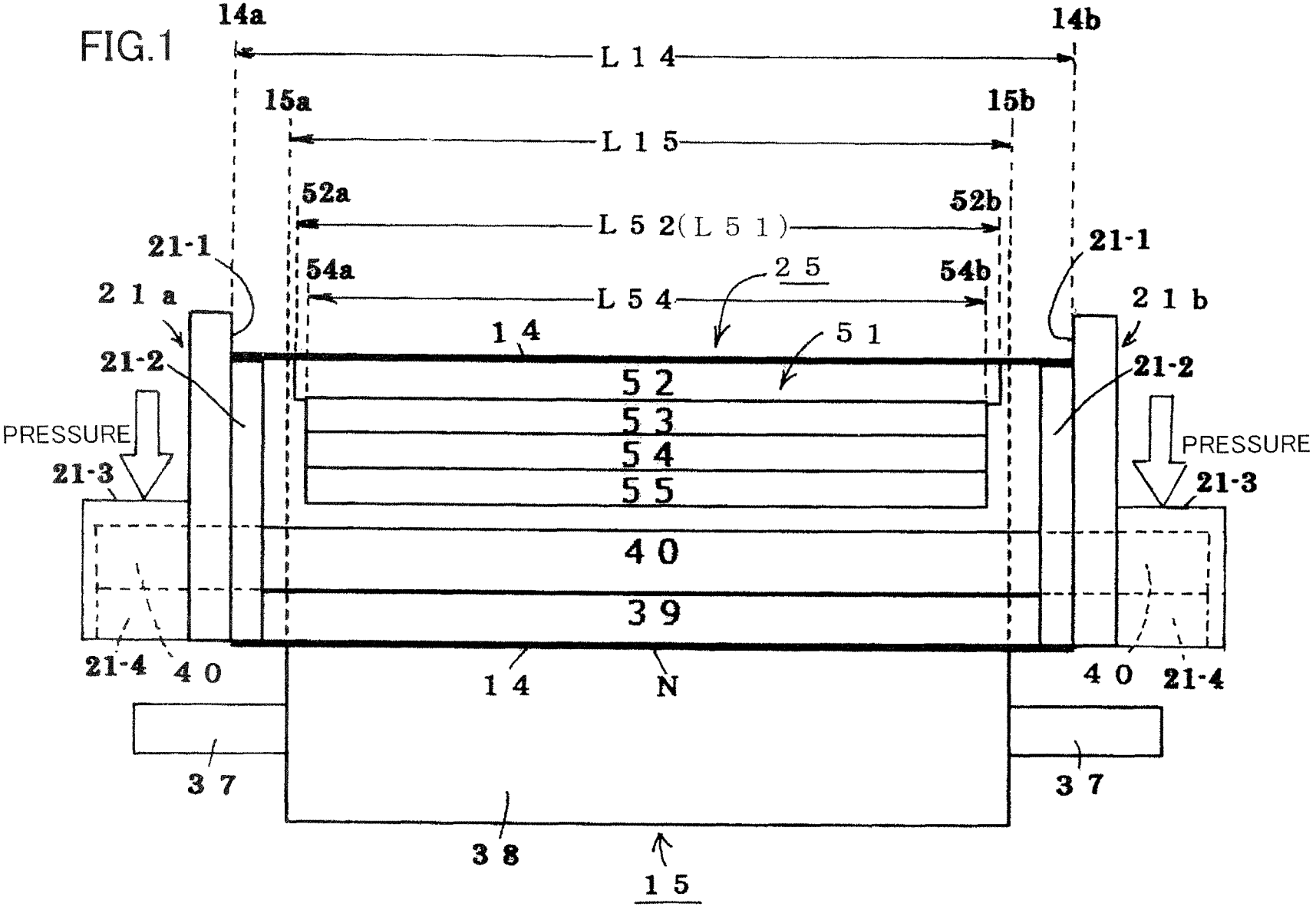
FIG. 1 is a front schematic diagram illustrating a fixing unit of a first embodiment from which main parts are partially cut away. (a drawing which illustrates a feature of the present disclosure).
Figure 3:
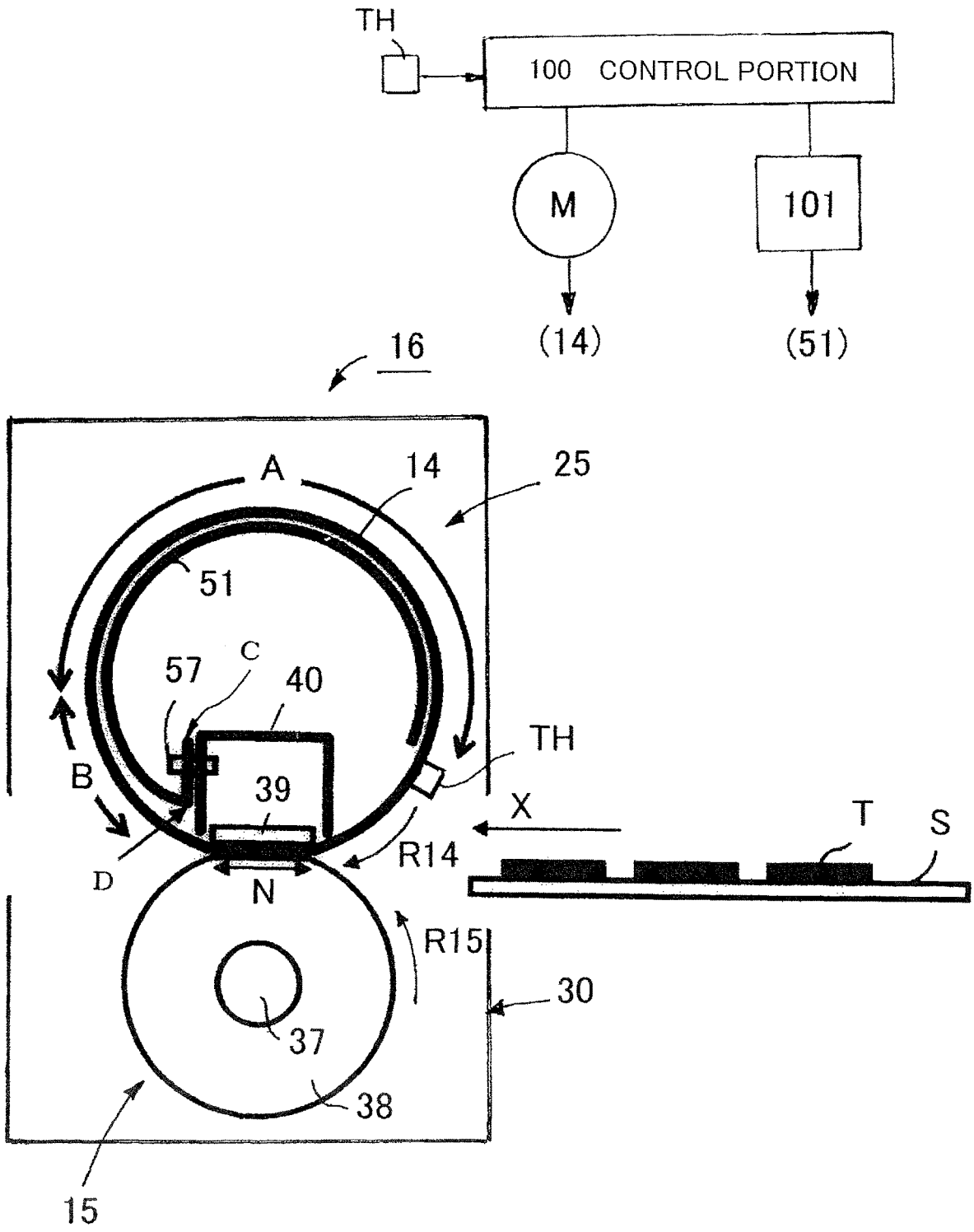
FIG. 3 is a transverse schematic diagram of the fixing unit of the first embodiment.

FIG. 3 is a transverse schematic diagram of the fixing unit, i.e., the image heating apparatus, 16 of the present embodiment and FIG. 1 is a front schematic diagram illustrating the fixing unit 16 from which main parts are partially cut away.

Here, in the following description, a longitudinal direction (width direction) is an axial direction of a rotary member or a generatrix direction or a direction in parallel thereto, and a short direction is a direction orthogonal to the longitudinal direction in terms of the fixing unit 16 or its constructional members. A front side is a side of inputting the recording material and a back side is a side of outputting the recording material. Left and right directions are those when the fixing unit 16 is seen from the front side. In the present embodiment, a longitudinal left side will be referred to as a first end side or a front side and a longitudinal right side as a second end side or a rear side. FIG. 1 illustrates a main part of the fixing unit 16 when seen from the front side. Up and down refer to those in terms of the gravity direction.

Roughly, the fixing unit 16 includes:

a) a heating unit 25 including a heating belt or a fixing film 14 serving as an endless belt member, i.e., an endless belt, rotatable while heating an image on the recording material;

b) an elastic pressure roller 15 serving as a pressure rotary member or a nip forming member defining a nip portion N for heating or fixing the toner image T on the recording material while nipping and conveying the recording material S in cooperation with the heating belt 14; and c) An apparatus frame or an apparatus case 30 storing the units described above.

1. Heating Unit

The heating unit 25 is an assembly of the heating belt 14, a pressure pad 39 and a stay 40 disposed inside of the heating belt 14, a sheet-like heating heater 51, i.e., a sheet-like heating element, having elasticity as a heating member, flange members 21*a* and 21*b* on the first and second end sides and others.

1) Heating Belt

The heating belt 14 is a heat-resistant, flexible and thin hollow heat transfer member and exhibits approximately hollow cylindrical shape by its own elasticity in a free condition.

The heating belt 14 includes a base layer made of a heat-resistant resin such as polyimide, polyimidoamide, PEEK (polyether ether ketone) or the like, heat-resistant and high heat conductive SUS (stainless steel) and a pure metal of or an alloy of Al, Ni, Cu, Zn and the like. In a case of a resin-made base layer, high heat conductive powder of BN, alumina or Al may be blended in order to improve thermal conductivity. A release layer is formed as a surface layer by coating with a heat-resistant resin having favorable releasing nature such as the following fluorocarbon resin or silicon resin in order to prevent offset of toners and to assure separability of the recording material.

PTFE (polytetrafuluoroethylene)

PFA (tetrafluoroethylene-perfluoroalkyl vinyl ether copolymer)

FEP (tetrafluoroethylene-hexafluoropropylene copolymer)

ETFE (Ethylene-tetrafluoroethylene copolymer)

CTFE (polychrorotrifuloroethylene)

PVDF (polyvinylidene fluoride) and others

In the present embodiment, PFA is used as the release layer. As a coating method, the release layer may be dipped or powder spray may be applied after etching an outer surface of the belt base layer (or an intermediate material layer laminated thereon). Or, the surface of the belt base layer may be covered by a resin formed into a tube-like shape. Or, the release layer formed into the shape of a tube in advance may be covered after blasting an outer surface of the belt base layer and applying a primer layer serving as an adhesive layer.

The heating belt 14 of the present embodiment has three layered structure of the base layer, an intermediate layer and the release layer sequentially from inside to outside. The base layer is made of polyimide of 80 μm in thickness and 30 mm of inner diameter, silicone rubber of 200 μm in thickness is then overlapped as the intermediate layer around an outer circumferential surface of the base layer and the PFA tube of 30 μm in thickness is then overlapped on the outer circumferential surface as the release layer.

2) Pressure Pad

The pressure pad 39 is a member or a backup member or a pressing member in sliding contact with the inner surface of the heating belt 14 and is a heat-resistant and heat insulating member which is lengthy and thin along the longitudinal direction of the heating belt 14.

3) Stay

The stay 40 serving as a support member or an inner member is a stiff member which is lengthy in the longitudinal direction of the heating belt 14 and which can receive a reaction force from the pressure roller 15. The stay 40 is preferable to be made of a material which is hardly bent even if a high pressure is applied. In the present embodiment, the stay 40 is made of SUM (sulfur and sulfur-composite free-cutting steel), is 1 mm thick and is bent at two points in the transverse section view of FIG. 3. The pressure pad 39 is fixed longitudinally along a lower surface of the stay 40 and is configured such that the lower surface of the pressure pad 39 is slidable with the inner surface of the heating belt 14.

4) Heating Heater

The sheet-like heating heater 51 is a heat source heating the heating belt 14 from the inner surface side thereof by being in surface contact with the inner surface of the heating belt 14. In FIG. 3, an area C of upstream end in the rotation direction R14 of the heating belt 14 of the heating heater 51 is approximately fixed, i.e., locked, to the stay 40 by screws 57 as a fixed end inside of the heating belt 14. The heating heater 51 heats the heating belt 14 from the inner surface by being in surface contact with the inner surface of the heating belt 14 in a downstream area A, i.e., a free end side not fixed.

Characteristic configurations of the heating heater 51 will be described later. Note that FIG. 1 illustrates the heating heater 51 by exaggerating thicknesses of the respective layers 52 through 55 of the laminated layer composing the heating heater 51.

The heating belt 14 in 1) is loosely and externally fitted or externally inserted around the assembly of the pressure pad 39 of 2), the stay 40 of 3) and the heating heater 51 of 4). The first and second ends of the stay 40 project out of openings of the first and second ends of the heating belt 14, respectively.

5) Flange Members

The flange members (referred to simply as 'flanges' hereinafter) 21*a* and 21*b* on the first and second end sides are fitted respectively around parts on the first and second end sides of the stay 40 projecting out of the openings on the first and second end sides of the heating belt 14. The heating belt 14 is positioned between end restricting surfaces (flange portions) 21-1 and 21-1 facing to each other of the both flanges 21*a* and 21*b*.

The flanges 21*a* and 21*b* of the first and second end sides are regulating members for regulating a longitudinal move and peripheral shape of the heating belt 14 in the heating unit 25. The flanges 21*a* and 21*b* of the first and second end sides are molded parts of heat-resistant resin (PPS, liquid crystal polymer, phenol resin or the like) formed into a bilaterally symmetrical shape, respectively.

Figure 7:
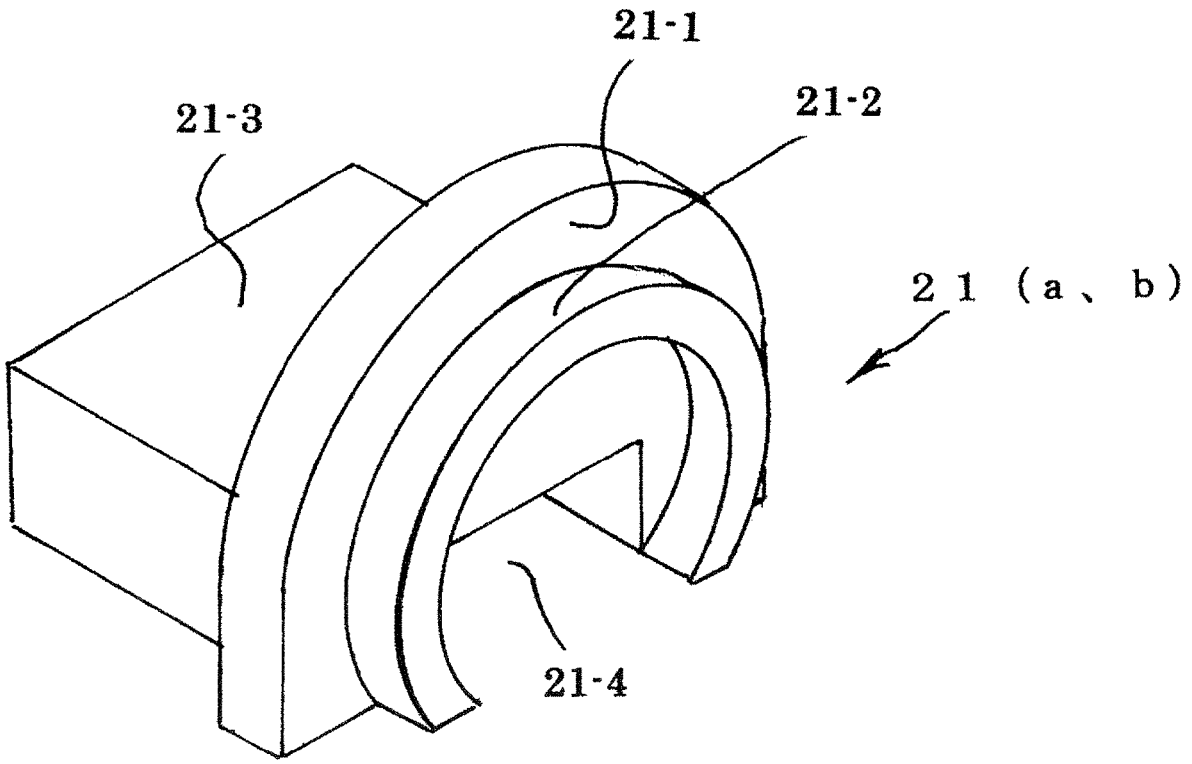
FIG. 7 is a perspective schematic diagram illustrating an overview of a flange.

FIG. 7 is a perspective schematic diagram illustrating an overview of the flange 21*a* or 21*b*. The flange 21*a* or 21*b* includes the end regulating surface 21-1 described above and also an inner circumference regulating surface 21-2 receiving an end inner circumferential surface of the heating belt 14, a pressed portion (pressure receiving portion) 21-3 serving as a pressure receiving portion, and a stay end fitting portion 21-4. The end regulating surface 21-1 regulates the longitudinal move of the heating belt 14 by being in contact with a longitudinal end portion 14*a* or 14*b* of the heating belt 14.

Pressure Roller

The pressure roller 15 is an elastic roller including an elastic layer 38 such as an elastic solid rubber layer, an elastic sponge rubber layer and an elastic foam rubber layer layered around a metallic cored bar 37 such as SUS, SUM (sulfur and sulfur-composite free-cutting steel) and Al.

Here, the elastic solid rubber layer is formed of heat-resistant rubber such as silicon rubber and fluororubber. The elastic sponge rubber layer is formed by foaming the silicon rubber in order to have more heat insulating effect. The elastic foamed rubber layer is what hollow fillers such as micro-balloons are dispersed within the silicon rubber layer to enhance the heat insulating effect by providing gas portions within the hardened article. The release layer such as the PFA resin and the PTFE resin may be formed thereon.

The pressure roller 15 of the present embodiment adopts SUS as the metal bar 37 and an elastic solid silicon rubber layer as the elastic layer 38 so as to have an outer diameter of 25 mm.

The pressure roller 15 is rotatably supported through bearings not illustrated between the first and second end sides such that the first and second end parts of the metal bar 37 are supported between side plates not illustrated of the first and second sides of the unit frame 30. The heating unit 25 is disposed approximately in parallel with the pressure roller 15 while facing a side of the pressure pad 39 to the pressure roller 15 between the side plates of the first and second sides.

Then, each of the pressed portion 21-3 of the flanges 21*a* and 21*b* respectively fitted to the first and second end sides of the stay 40 is urged by a predetermined pressure in an axial line direction of the pressure roller 15 by a pressure mechanism not illustrated.

Thereby, the lower surface of the pressure pad 39 comes into pressure contact with the pressure roller 15 through the heating belt 14 by resisting against the elasticity of the elastic layer 38 of the pressure roller 15 with the predetermined pressure. Then the nip portion N of a predetermined width necessary for heating an image is defined between the heating belt 14 and the pressure roller 15 in terms of a conveyance direction X of the recording material S.

Fixing Operation

The heating belt 14 includes driving gears not illustrated on the first and second end sides thereof, is directly driven by driving portion serving as a driving motor M controlled by a control portion 100 and is rotationally driven with a predetermined peripheral speed clockwise as illustrated by an arrow R14 in FIG. 3. Along with the rotation of the heating belt 14, the pressure roller 15 is rotated counter-clockwise as indicated by an arrow R15 by a frictional force with the heating belt 14 in the nip portion N.

Meanwhile, the heating heater 51 generates heat by power supplied from a power supply 101, controlled by the control portion 100, through a power feeding path not illustrated. The heating heater 51 is in surface contact with the inner surface of the heating belt 14 at the area A, so that the rotating heating belt 14 is heated from inside by the heat of the heating heater 51.

Then, external surface temperature of the heating heater 51 is detected by a temperature detector TH such as a thermistor, and information of detected temperature is fed back to the control portion 100. Based on the information of the temperature of the heating belt 14 detected by the temperature detector TH, the control portion 100 controls the power supplied from the power supply 101 to the heating heater 51 such that the temperature of the heating belt 14 is increased and is kept at a predetermined target temperature.

In the condition of the fixing unit described above, the recording material S bearing the non-fixed toner image is introduced from the printer portion 50 to the fixing unit 16 and is nipped and conveyed by the nip portion N. In a process of being nipped and conveyed by the nip portion N, heat of the heating belt 14 is applied to the recording material S. The non-fixed image T is melt by the heat of the heating belt 14 and is fixed to the recording material S by the pressure applied to the nip portion N.

Heating Heater

Figure 4:
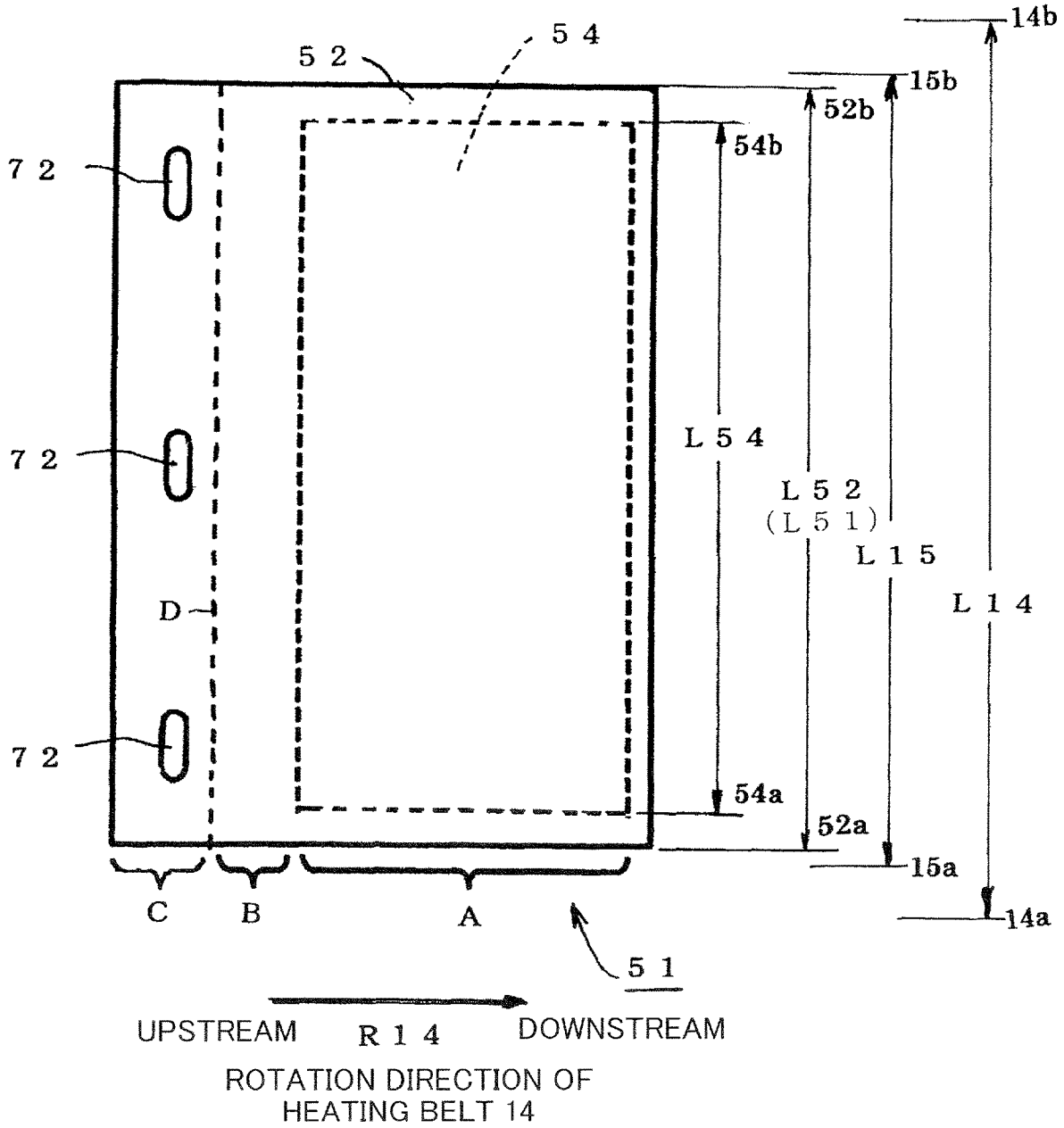
FIG. 4 is a developed plan view illustrating a sheet-like heating heater.

FIG. 4 is a developed plan view illustrating the elastic sheet-like heating heater 51. The heating heater 51 includes the area A on a downstream end side in contact with the inner surface of the heating belt 14, the area C on an upstream end side and the area B between the areas A and C in terms of the rotation direction R14 of the heating belt 14. A part indicated by D in the area C of the upstream end side is bent. Still further, a plurality of screw holes 72 is provided at certain intervals along the longitudinal direction in the area C.

Figure 5:
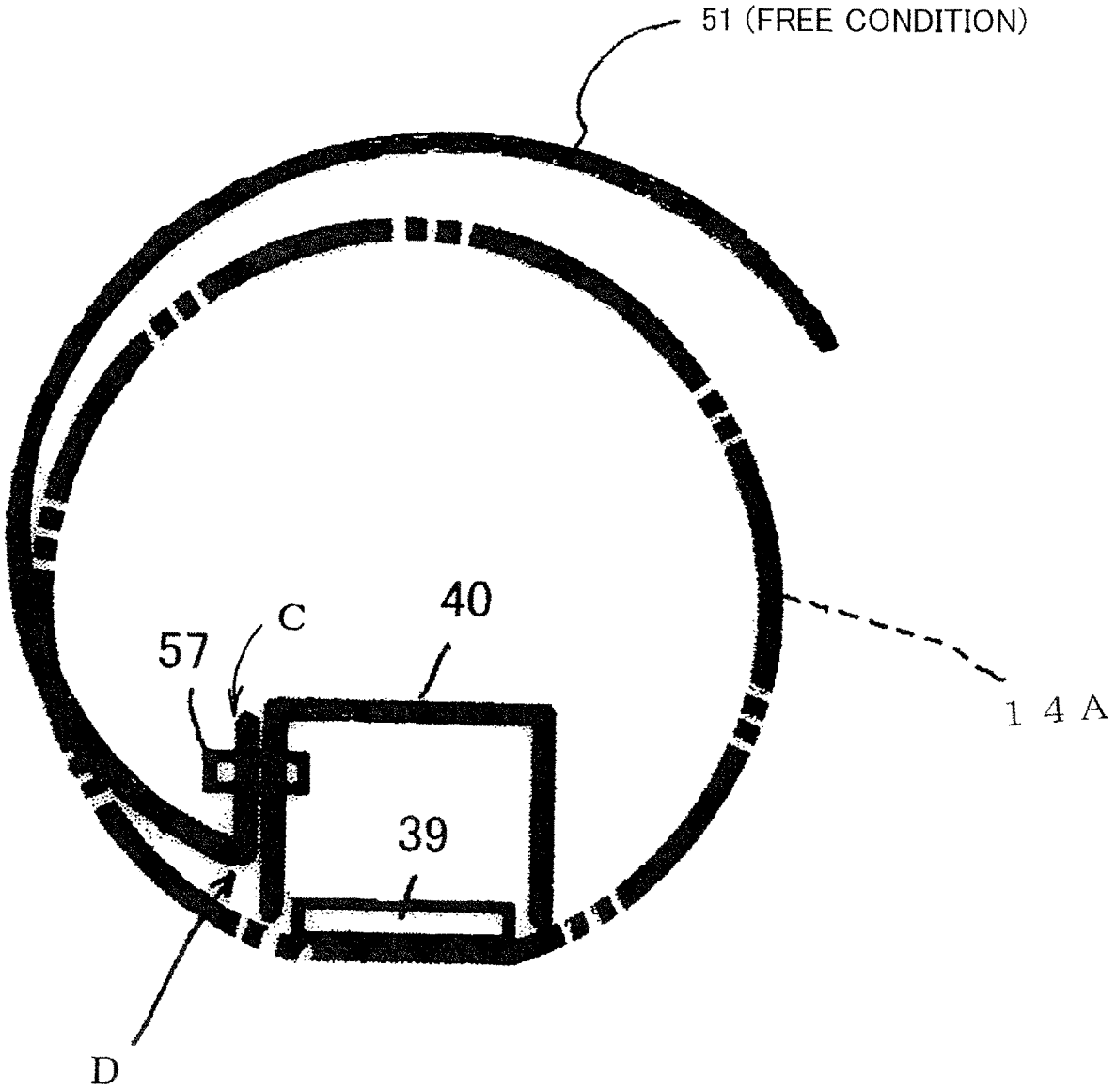
FIG. 5 is a transverse schematic view illustrating a shape of the heating heater in a free condition.

The heating heater 51 is approximately fixed to the stay 40 which is an internal member of the heating belt 14 such that the area C on the upstream end side serves as a fixed end side in terms of the rotation direction R14 of the heating belt 14 by screwing the screws 57 as illustrated in FIG. 3 into the screw holes 72 in the area C with the stay 40. The heating heater 51 extends outside of a profile line (imaginary line) 14A indicating the heating belt 14 in a free condition, i.e., in a condition in which there is no heating belt 14 as illustrated in FIG. 5. That is, the heating heater 51 has a shape of extending outside of the outer profile of the heating belt 14 by its own elasticity.

Then, the heating heater 51 is provided inside of the heating belt 14 as illustrated in FIG. 3 by resisting against its own elasticity such that the area C on the upstream end side when the heating heater 51 is seen along the rotation direction R14 of the heating belt 14 is approximately fixed to the stay 40 as the fixed end side. In this condition, a shape of the heating heater 51 in a free condition as illustrated in FIG. 5 is regulated by the inner circumferential surface of the heating belt 14 while resisting against its own elasticity and the heating heater 51 comes into surface contact with the inner surface of the heating belt 14 in the area A on the downstream end side, i.e., on the free end side not fixed. The heating heater 51 hardly comes into contact with the inner surface of the heating belt 14 in the intermediate area B.

Note that there is a gap between the heating belt 14 and the heating heater 51 in the area A in the schematic diagram of FIG. 3 for convenience to distinguish them. However, the heating heater 51 is elastically surface contact with the inner surface of the heating belt 14 in the area A on the downstream end side along the rotation direction R14 of the heating belt 14 as described above.

Figure 6:
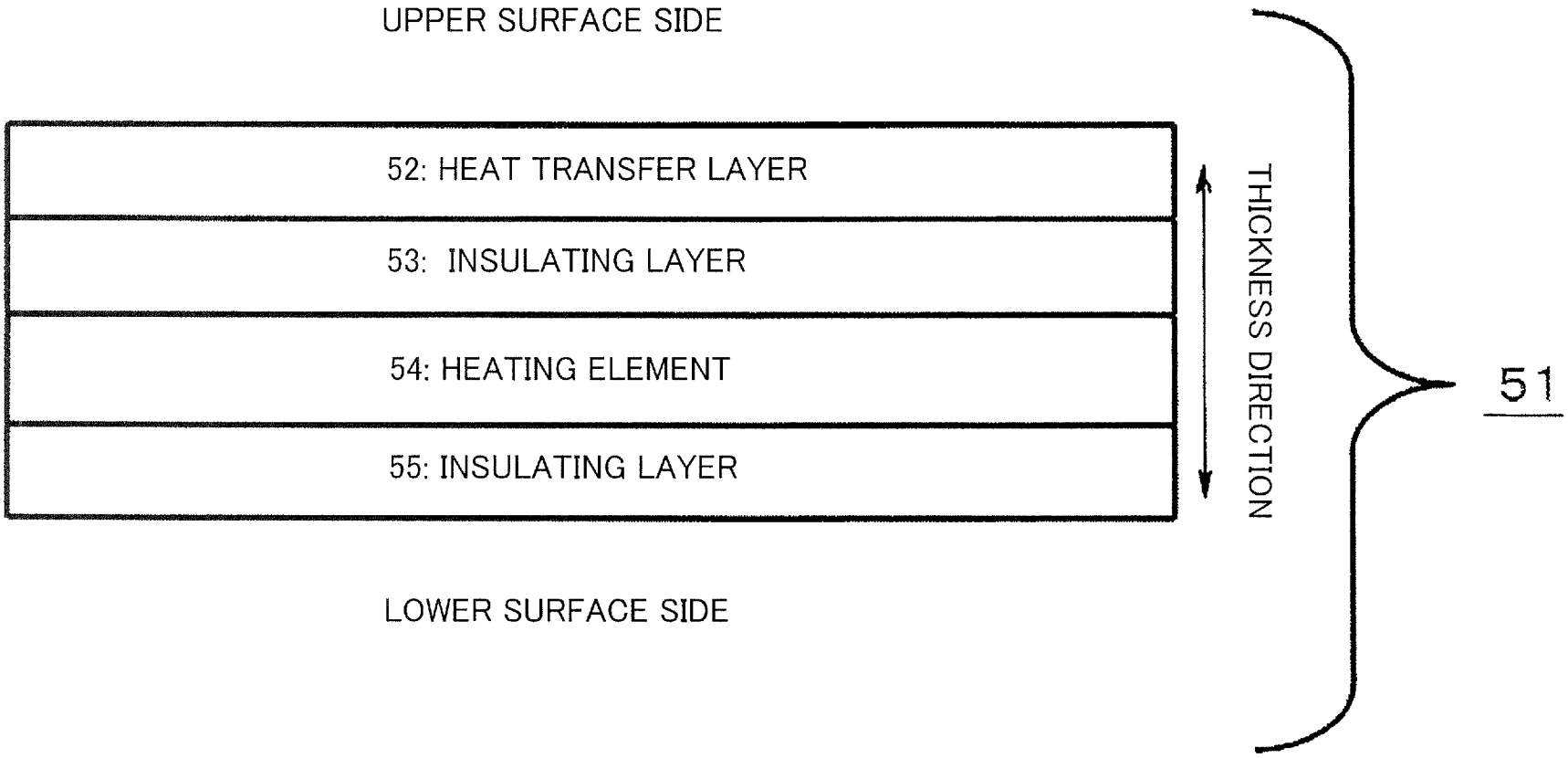
FIG. 6 is a schematic diagram illustrating a layered structure of the heating heater.

FIG. 6 is a cross-sectional schematic diagram illustrating a layered structure of the heating heater 51. The heating heater 51 has a four-layer laminated structure of a first layer 52, a second layer 53, a third layer 54 and a fourth layer 55 sequentially from an upper surface side to a lower surface side, where a side facing the inner surface of the heating belt 14 is the upper surface side and a side opposite to the upper surface side is a lower surface side in terms of its thickness direction.

The first layer 52 is a heat transfer layer having elasticity. A material thereof is SUS, i.e., a metal-base material, and a thickness thereof is 30 μm. Beside SUS, a pure metal or an alloy such as Al, Ni, Cu and Zn may be used as the material of the heat transfer layer 52. Elastic force, i.e., bending reaction, of the heat transfer layer 52 makes it possible to assure adhesion of the heating heater 51 with the inner surface of the heating belt 14 and to homogeneously heat the heating belt 14. Thus, the heat transfer layer 52 having elasticity is necessary to prevent nonuniformity otherwise caused in a heating pattern and in contact. The SUS layer is necessary also for the heating heater 51 to elastically come into contact.

An insulating layer made of polyimide of 25 μm in thickness is brought into contact with an inner side of the heat transfer layer 52 as the second layer 53. The heating element serving as the heating portion made of SUS of 30 μm in thickness is provided under the insulating layer 53 as the third layer 54. Provided inside of the insulating layer 53 is an insulating layer made of polyimide of 25 μm in thickness as the fourth layer 55 to sandwich the heating element 54 together with the insulating layer 53 of the second layer. That is, the heating element 54 is sandwiched by the two insulating layers of the second and fourth layers 53 and 55. Power feeding portions not illustrated are provided on the first and second end sides of the heating heater 51 to supply power to the heating element 54.

An area where the heating element 54 exists, i.e., a heating area, is a range of the area A in FIGS. 3 and 4. This range of the area A is a range where the heating heater 51 is in contact with the heating belt 14, and heat from the heating element 54 is transmitted to the heating belt 14 through the heat transfer layer 52 in this range. The area A of the heating heater 51 is in contact with the inner surface of the heating belt 14 in the area different from the area where the nip portion N is defined in terms of the peripheral direction of the heating belt 14.

The area B in FIGS. 3 and 4 is an intermediate area upstream of the area A, i.e., the heating area, and downstream of the fixed end, i.e., the fixed area C, in terms of the direction in which the heating belt 14 moves, i.e., the rotation direction. The heating element 54 does not exist in the area B, and the heating heater 51 is hardly in contact with the heating belt 14 in the area B. Note that the heating element 54 may be arranged to exist near a boundary with the area A in the area B.

In FIGS. 1 and 4, L14 denotes a linear dimension or a width dimension of the heating belt 14, L15 denotes a linear dimension or a width dimension of the pressure roller 15, L52 denotes a linear dimension or a width dimension of the heat transfer layer 52. In the present embodiment, a linear dimension L51 of the heating heater 51 is equal to the linear dimension or width dimension of the heat transfer layer 52. The linear dimension L15 of the pressure roller 15 is equal to a linear dimension L38 or a width dimension of the elastic layer 38 defining the nip portion N.

In the present embodiment, the linear dimension L14 of the heating belt 14 is 340 mm and the linear dimension L15 (L38) of the pressure roller 15 is 333 mm. Then, a recording material of maximum width size that can be introduced into the fixing unit 16 is set to be A4 (210 mm×297 mm) long edge feed. In order to accommodate with that, the linear dimension L51 (L52) of the heating heater 51 is set to be 330 mm under an environment of 25° C.

Characteristic Parts

In FIGS. 1 and 4, L54 denotes a linear dimension (width dimension) of the heating element 54 of the heating belt 14 and is set to be equal to or shorter than the linear dimension L52 of the heat transfer layer 52 of the heating heater 51, having a dimensional relationship of L52≥L54. Inversely, if the heat transfer layer 52 is shorter than the heating element 54, temperature of the protruding heating element 54 increases excessively. In the present embodiment, the linear dimension L54 of the heating element 54 is 326 mm which is shorter than 330 mm of the linear dimension L52 of the heat transfer layer 52. Note that linear dimensions (width dimensions) of the insulating layers 53 and 55 are set to be 326 mm which is equal to the linear dimension L54 of the heating element 54.

That is, what is characteristic in terms of the longitudinal direction is that both end portions 52*a* and 52*b* of the heat transfer layer 52 are disposed outside of both end portions 54*a* and 54*b* of the heating element 54 and disposed inside of both end portions 15*a* and 15*b* of the pressure roller 15. Here, the both end portions of the pressure roller 15 are both end portions of an area defining the nip portion together with the heating belt 14 as illustrated in FIG. 1. The metal bar part which is a rotation shaft is excluded.

Figure 8:
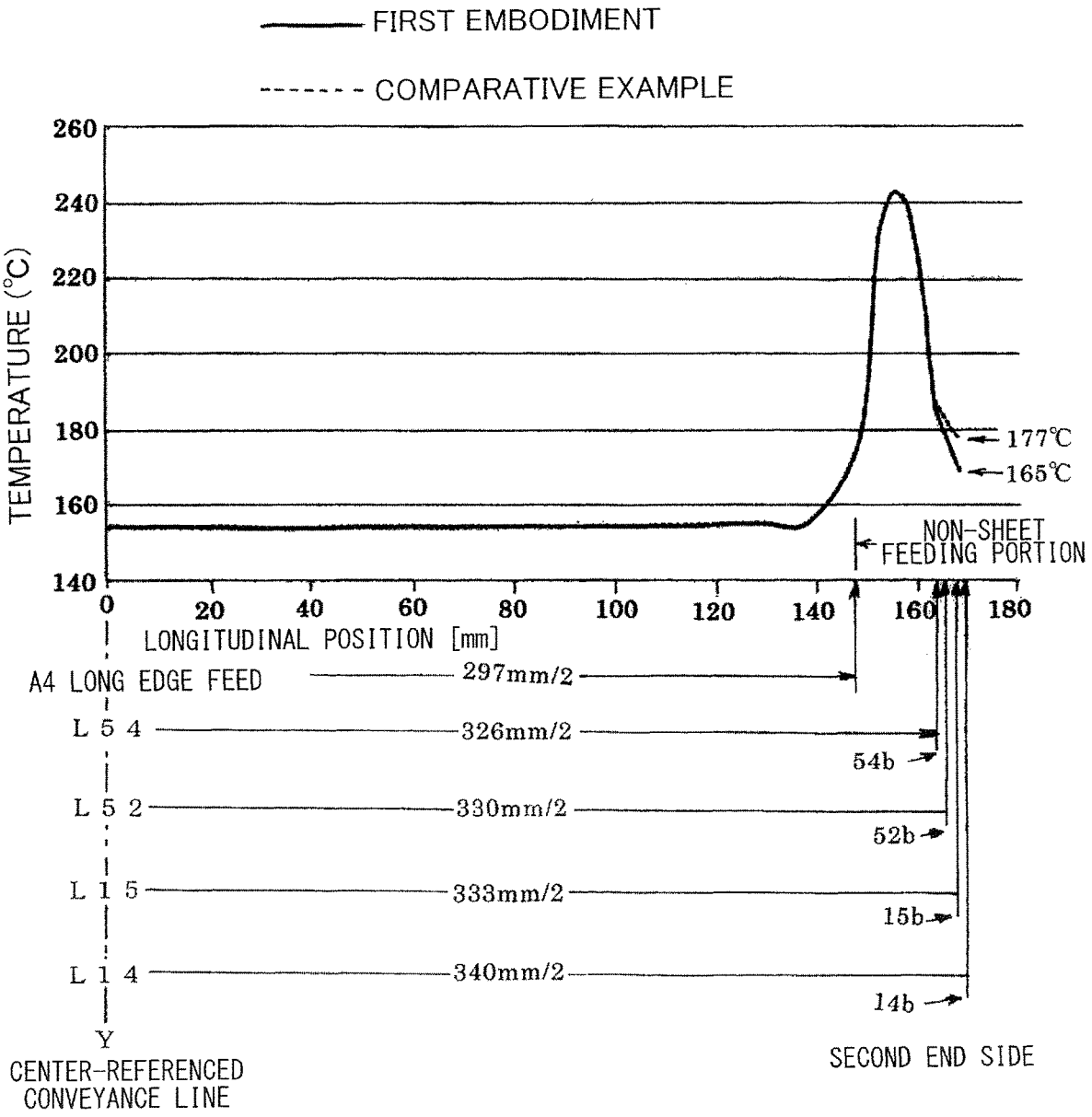
FIG. 8 is a longitudinal temperature graph of the heating belt in continuously feeding sheets.

The introduction of the recording materials of various width sizes of the fixing unit 16 of the present embodiment is made by so-called center-referenced conveyance. FIG. 8 is a longitudinal temperature graph of the heating belt 14 in continuously feeding 500 sheets by using A4-size normal sheet (64 g/sheet) as the recording material in a long edge feed mode in which the long edge of the sheet becomes the leading side in a sheet conveyance direction. For convenience, FIG. 8 indicates the temperature graph of a part from a center-referenced conveyance line Y (imaginary line) of the recording material to the second end side of the heating belt 14. A temperature graph of a part from the center-referenced conveyance line Y of the recording material to the first end side of the heating belt 14 is also almost the same.

According to the configuration of the first embodiment, the both end portions 52*a* and 52*b* of the heat transfer layer 52 are disposed inside of the both end portions 15*a* and 15*b* of the pressure roller 15. Due to that, in continuously feeding the A4-size normal sheets, heat whose temperature has raised at a non-sheet feed portion, i.e., a part where the recording material does not pass, is hardly transmitted to the end portions 14*a* and 14*b* of the heating belt 14 through the heat transfer layer 52, and temperature at the both end portions of the heating belt 14 could be suppressed to 165° C.

Then, a durability test in continuously feeding the A4 sheets was also carried out. As a result, a favorable durability result could be obtained even after feeding 150,000 sheets. That is, the heating belt 14 did not fall out of the flange 21 by being shaved by abrasion of the end portion of the heating belt 14 with the end regulating surface 21-1 and the inner circumference regulating surface 21-2 of the flange 21.

That is, according to the fixing unit of the present embodiment, it is possible to suppress the temperature rise of the end portions of the heating belt 14 because they are not affected by the heating element 54 in the non-contact area where the heating belt 14 serving as the fixing member is not in contact with the pressure roller 15 serving as the pressure member. This arrangement makes it possible to reduce the abrasion between the heating belt 14 and the flange abutment surface.

COMPARATIVE EXAMPLE

Figure 9:
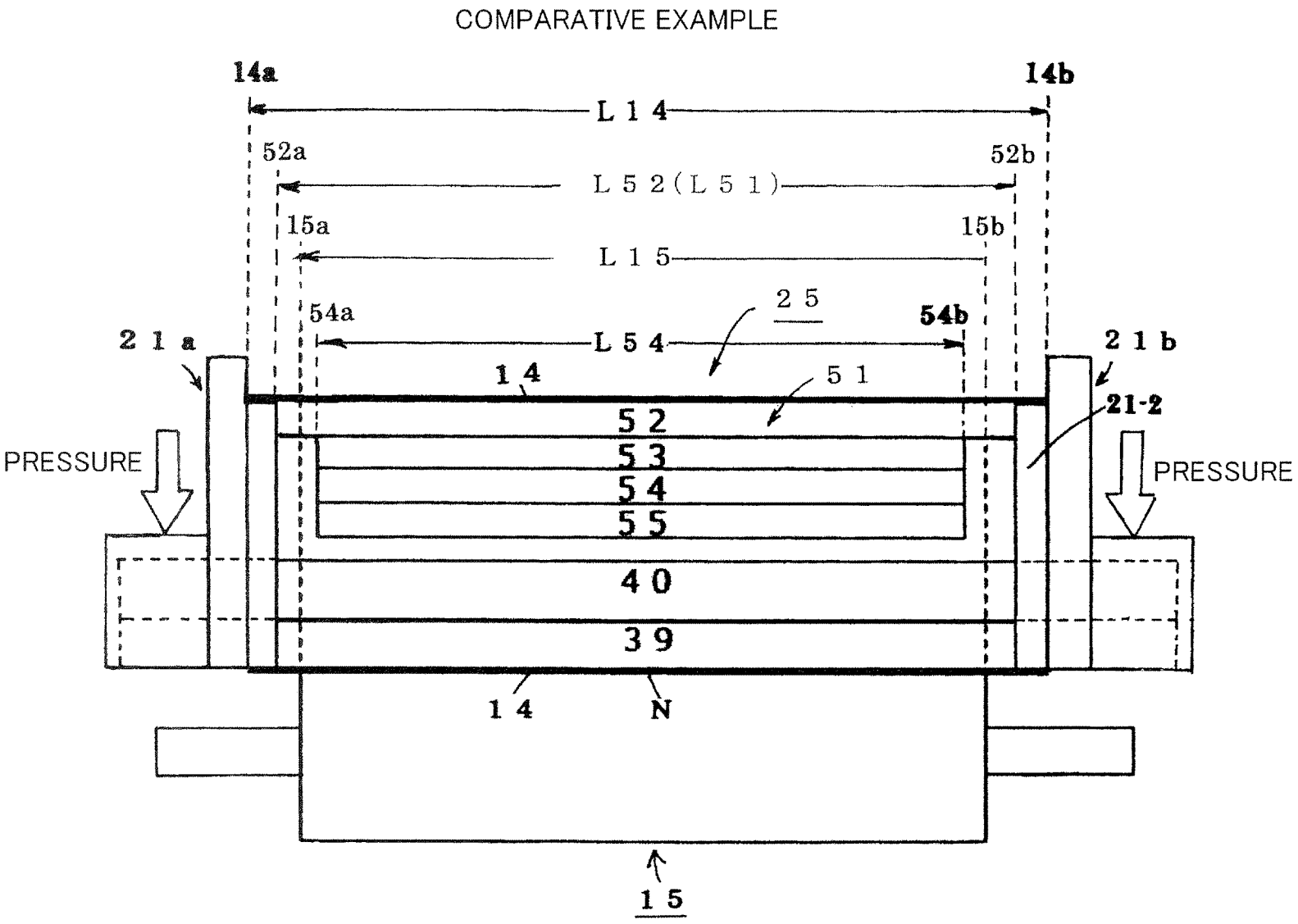
FIG. 9 is a front schematic diagram of a fixing unit of a comparative example from which main parts are partially cut away.

FIG. 9 is a structure diagram of a fixing unit of a comparative example. In the fixing unit of the comparative example, a linear dimension L52 of the heat transfer layer 52 of the heating heater 51 is set to be 336 mm which is longer than a linear dimension L15 of 333 mm of the heating heater 51, i.e., L52>L15.

That is, in terms of the longitudinal direction, while the both end portions 52*a* and 52*b* of the heat transfer layer 52 are disposed outside of the both end portions 54*a* and 54*b* of the heating element 54, they are also disposed outside of both end portions 15*a* and 15*b* of the pressure roller 15. The configuration of the fixing unit and the dimensional relationship other than that are the same with those of the fixing unit of the first embodiment.

In the configuration of the fixing unit of the comparative example, the both end portions 52*a* and 52*b* of the heat transfer layer 52 are disposed outside of the both end portions 15*a* and 15*b* of the pressure roller 15. That is, the comparative example is configured such that the heat raised at the non-sheet feed portion is liable to be transmitted to the end portions 14*a* and 14*b* of the heating belt 14 through the heat transfer layer 52. Therefore, temperature of the both end portions of the heating belt 14 has raised to 177° C. (see the comparative example in FIG. 8) in continuously long edge printing 500 sheets by using the A4 size normal sheet (64 g/sheet) in the same manner with the first embodiment.

Then, as a result of conducting a durability test of continuously feeding the A4 sheets, durability was NG after feeding 135,000 sheets. That is, the heating belt 14 fallen out of the flange 21 by being shaved by abrasion of the end portions of the heating belt 14 with the end regulating surface 21-1 and the inner circumference regulating surface 21-2 of the flange 21.

Second Embodiment

Figure 10:
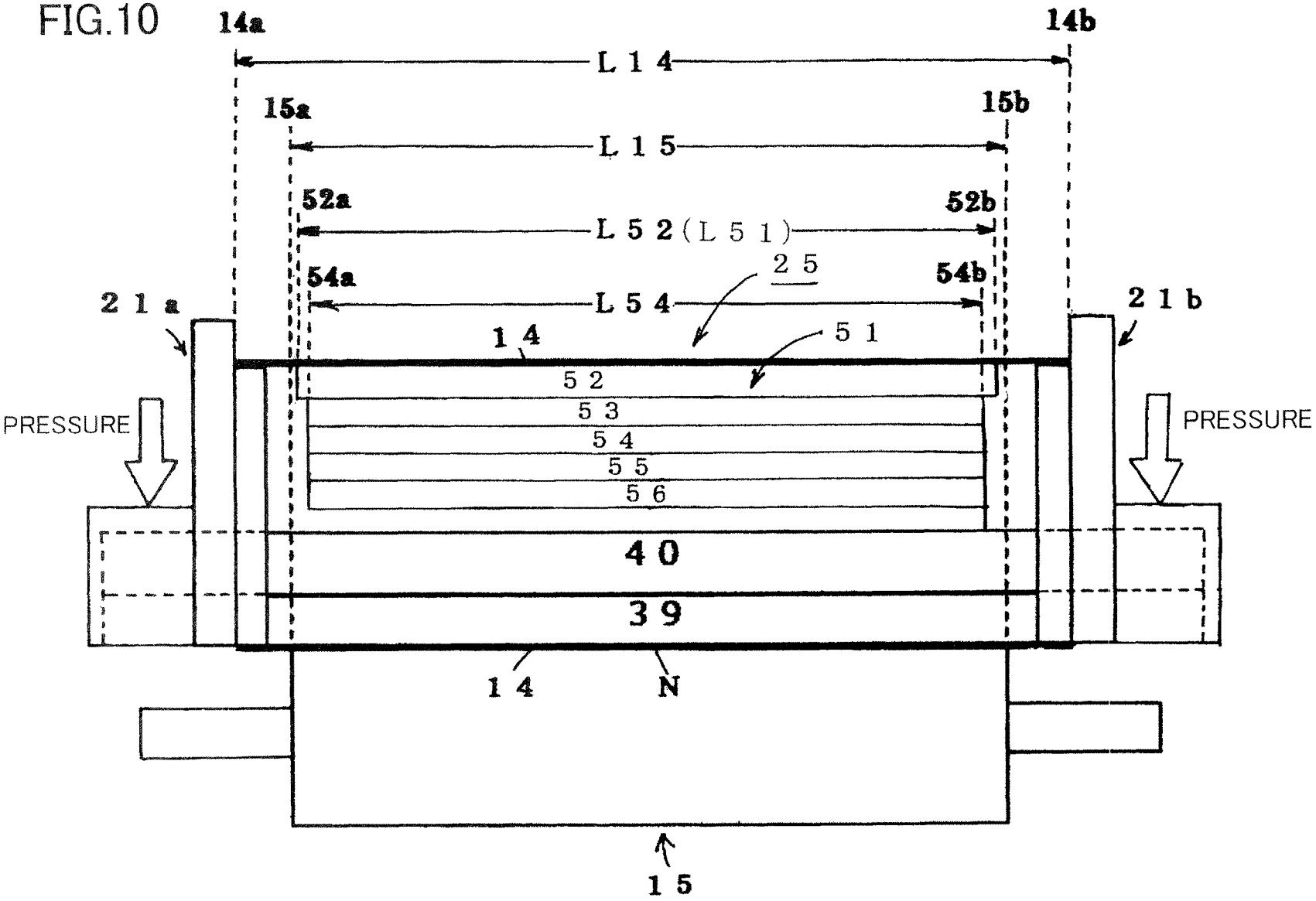
FIG. 10 is a front schematic diagram of a fixing unit of a second embodiment from which main parts are partially cut away.
Figure 11:
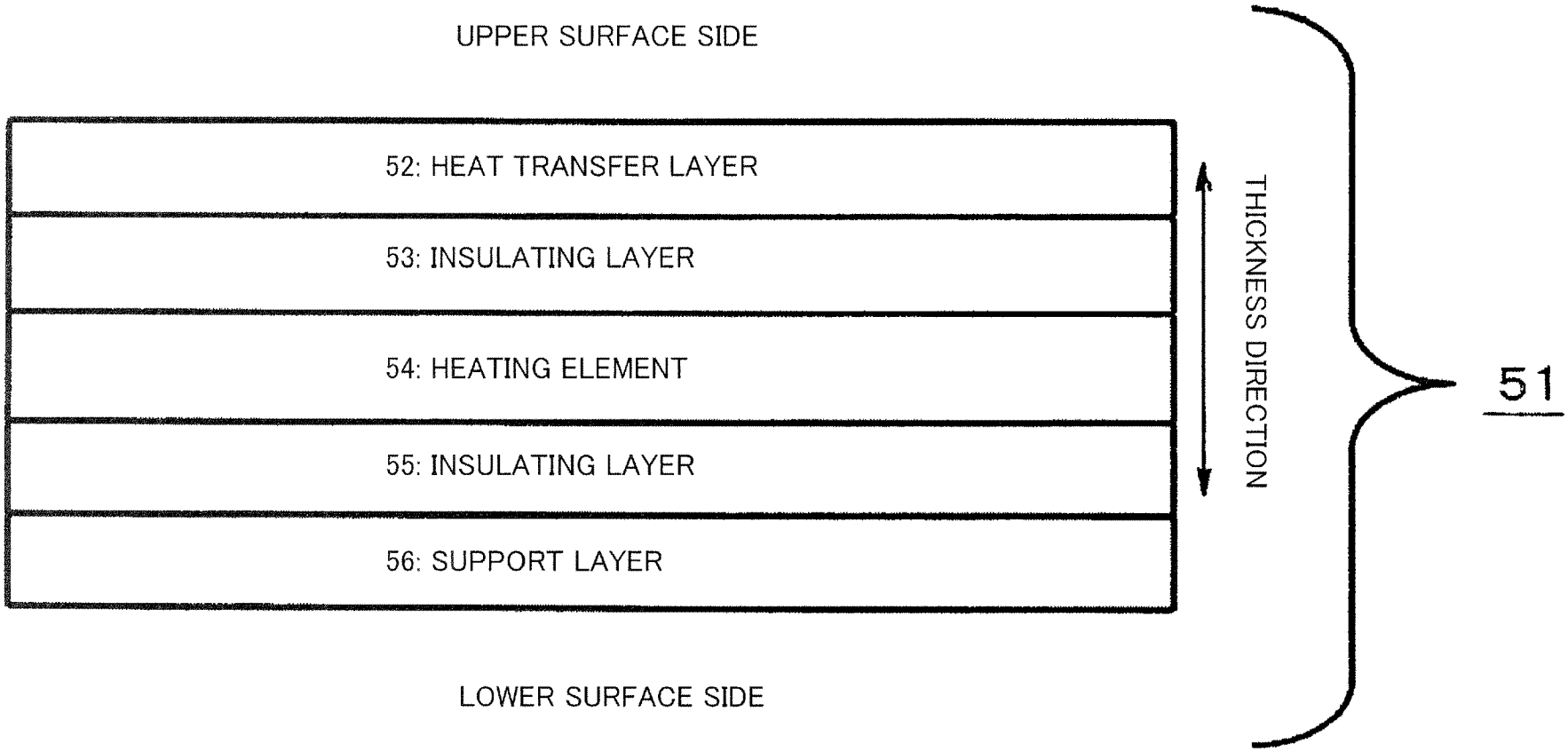
FIG. 11 is a schematic diagram illustrating a layered structure of a heating heater of the second embodiment.

FIGS. 10 and 11 illustrate configurations of a fixing unit of a second embodiment corresponding respectively to FIGS. 1 and 6 of the first embodiment.

While the heat transfer layer 52 serving as the first layer of the heating heater 51 is endowed with two functions of the heat transferring function and the elastic function in the first embodiment, these two functions are separated in the present embodiment. That is, the heating heater 51 is constructed to be a five-layer structure of first through fifth layers as illustrated in FIG. 11 in the second embodiment. While the first layer is the heat transfer layer 52, it has no elastic function and is made of graphite, i.e., a carbon-base material, of 50 μm in thickness in the present embodiment. The second, third and fourth layers are the insulating layer 53, the heating element 54 and the insulating layer 55 similarly to the heating heater 51 of the first embodiment.

The fifth layer is a support layer 56 as an elastic functional layer and is made of SUS of 30 μm in thickness and is in contact with a lower surface of the insulating layer 55, i.e., the fourth layer, to support the entire heating heater 51. A material of the support layer 56 may be a pure metal or an alloy of Al, Ni, Cu Zn and the like.

The adhesion of the heating heater 51 with the inner surface of the heating belt 14 could be assured because the heat transfer layer 52, i.e., the first layer, is made of elastic metal such as SUS in the heating heater 51 of the first embodiment. However, because graphite is used for the heat transfer layer 52, i.e., the first layer, it is difficult to assure the adhesion with the inner surface of the heating belt by elastic force, i.e., bending reaction. Due to that, the support layer 56 is disposed to assure the adhesion of the heating heater 51 with the inner surface of the heating belt 14 by elastic force, i.e., the bending reaction, of the support layer 56 and to heat the heating belt 14 homogeneously The configuration of the fixing unit and the dimensional relationship other than that are the same with those of the fixing unit of the first embodiment.

Characteristic Parts

What is characteristic in terms of the longitudinal direction in the second embodiment is also that the both end portions 52*a* and 52*b* of the heat transfer layer 52 are disposed outside of the both end portions 54*a* and 54*b* of the heating element 54 and disposed inside of the both end portions 15*a* and 15*b* of the pressure roller 15 as illustrated in FIG. 10. The linear dimensions (width dimensions) of the insulating layer 53 and 55 and of the support layer 56 are set to be equal with the linear dimension L54 of the heating element 54.

Accordingly, the same effect with that of the fixing unit of the first embodiment could be obtained. End temperature of the heating belt 14 is lowered and a durability improving effect of 10% could be obtained as compared to the comparative example by using graphite as the heat transfer layer 52.

Other Matters (1) The fixing unit of the present disclosure includes an image modifying unit for modifying glossiness or the like of an image fixed once or temporarily fixed (fixed image or semi-fixed image) on a regulating surface (this case is also referred to as a fixing unit).

(2) It is also possible to arrange the fixing unit such that the rotatable endless heating belt 14 heating an image on a recording material is driven as the pressure roller 15 is rotationally driven as a drive rotary member. The unit may be also arranged such that the flexible heating belt 14 is wrapped and suspended around two or more support members and is rotated by a rotation mechanism including the pressure roller 15 or by a rotation mechanism constructed otherwise.

(3) The printer portion 50, i.e., the image forming portion, is not limited be the electro-photographic system and may be an image forming portion of an electrostatic recording system or a magnetic recording system. The transfer method may be also arranged to be a direct method of forming a toner image onto a recording material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-140918, filed Jul. 27, 2018, which is hereby incorporated by reference herein in its entirety.

What is claimed is:

1. An image heating apparatus configured to heat an image on a recording material, comprising:

an endless belt;

a rotary member configured to form a nip portion, in which the recording material is nipped and conveyed and the image on the recording material is heated, with the endless belt;

regulating members comprising regulating surfaces for regulating the endless belt from moving in a longitudinal direction by being in contact with longitudinal ends of the endless belt; and a sheet-like heating member provided inside of the endless belt, the heating member comprising a fixed area located at a first end side in a rotation direction of the endless belt and fixed to an internal member of the endless belt and a heating area configured to be in contact with an inner surface of the endless belt along a peripheral direction in an area different from an area forming of the nip portion in the peripheral direction of the endless belt and to heat the endless belt, wherein the heating member comprises a heat transfer member in contact with the inner surface of the endless belt, and a heating portion located on an opposite side from a side, of the heating member, in contact with the inner surface of the endless belt across the heat transfer member, and wherein both end portions of the heat transfer member are disposed at the same location or outside of both end portions of the heating portion in the longitudinal direction and are disposed inside of both end portions of the rotary member in the longitudinal direction.

2. The image heating apparatus according to claim 1, wherein the heating portion is sandwiched by insulating layers.

3. The image heating apparatus according to claim 1, wherein the heating portion is provided in the heating area in the heating member.

4. The image heating apparatus according to claim 1, wherein the heating member is in contact with the inner surface of the endless belt by elastic force of the heating member.

5. The image heating apparatus according to claim 1, wherein the heat transfer member is made of a metal-base material.

6. The image heating apparatus according to claim 1, wherein the heat transfer member is made of a carbon-base material.

7. The image heating apparatus according to claim 1, wherein the heat transfer member is in contact with the inner surface of the endless belt by elastic force of the heat transfer member.

8. The image heating apparatus according to claim 1, wherein the heating member comprises a support member for bringing the heat transfer member into contact with the inner surface of the endless belt.

* * * * *